US009609987B2

(12) United States Patent
Christensen

(10) Patent No.: US 9,609,987 B2
(45) Date of Patent: Apr. 4, 2017

(54) COSMETIC AND GROOMING VACUUM

(71) Applicant: Elizabeth Christensen, Reno, NV (US)

(72) Inventor: Elizabeth Christensen, Reno, NV (US)

( * ) Notice: Subject to any disclaimer, the term of this patent is extended or adjusted under 35 U.S.C. 154(b) by 336 days.

(21) Appl. No.: 14/303,279

(22) Filed: Jun. 12, 2014

(65) Prior Publication Data

US 2014/0366312 A1 Dec. 18, 2014

Related U.S. Application Data

(60) Provisional application No. 61/833,997, filed on Jun. 12, 2013.

(51) Int. Cl.

| | |
|---|---|
| ***A47L 7/00*** | (2006.01) |
| ***A47L 9/30*** | (2006.01) |
| ***A47L 5/24*** | (2006.01) |
| ***A47L 9/06*** | (2006.01) |
| ***A47L 9/22*** | (2006.01) |
| ***A47L 9/28*** | (2006.01) |

(52) U.S. Cl.

CPC ..... *A47L 7/0066* (2013.01); *A47L 5/24* (2013.01); *A47L 7/009* (2013.01); *A47L 9/0666* (2013.01); *A47L 9/0673* (2013.01); *A47L 9/22* (2013.01); *A47L 9/2857* (2013.01); *A47L 9/30* (2013.01)

(58) Field of Classification Search

CPC ..... A47L 5/24; A47L 7/0066; A47L 7/009; A47L 9/0666; A47L 9/30; A47L 9/0673; A47L 9/2857; A47L 9/22

See application file for complete search history.

(56) References Cited

U.S. PATENT DOCUMENTS

| | | | | |
|---|---|---|---|---|
| 2,753,434 | A * | 7/1956 | Storm, Jr. | A45D 20/10 132/206 |
| 5,074,006 | A * | 12/1991 | Eremita | A47L 5/24 15/344 |
| 7,328,479 | B2 * | 2/2008 | Willenbring | A47L 9/2805 15/319 |
| 7,331,083 | B2 * | 2/2008 | Overvaag | A47L 9/248 15/324 |
| 2005/0081321 | A1 * | 4/2005 | Milligan | A47L 5/24 15/344 |
| 2009/0188067 | A1 * | 7/2009 | White | A47L 9/02 15/246.2 |
| 2009/0260179 | A1 * | 10/2009 | Walker | A47L 5/24 15/347 |

* cited by examiner

*Primary Examiner* — Robert Scruggs

(57) ABSTRACT

A cosmetic and grooming vacuum is an apparatus that cleans and removes unwanted particulate from a user's face such as debris, hair, or makeup. The apparatus includes a casing, a vacuuming mechanism, a filtering container, an exhaust port, and a plurality of accessory nozzles. The casing houses and serves as a base for the other components of the apparatus. The vacuuming mechanism is used to lift and remove the unwanted particulate off of the user's skin. The filtering container is used store the unwanted particulate within the casing so that the unwanted particulate can be disposed of at a later time. The exhaust port allows the outward fluid flow from the vacuuming mechanism to exit the casing. Each accessory nozzle is used to uniquely modify the suction force of the vacuuming mechanism such as with a brush nozzle or a pinpoint tip nozzle.

18 Claims, 5 Drawing Sheets

COSMETIC AND GROOMING VACUUM

The current application claims a priority to the U.S. Provisional Patent application Ser. No. 61/833,997 filed on Jun. 12, 2013.

FIELD OF THE INVENTION

The present invention relates generally to a compact handheld vacuum for general cosmetic and grooming purposes.

BACKGROUND OF THE INVENTION

Vacuums are a ubiquitous sight in the modern household, as the advent of vacuums has greatly reduced the amount of labor required for housecleaning. Over the years vacuum technology has been applied to a number of different areas, including cosmetics. Today, it is possible to buy specialized vacuums that are designed for use with the skin, facial or otherwise, however they are primarily marketed to medical or clinical specialists and used in those types of facilities. These vacuums are often used to apply a liquid cleaner, powder, or other material to aid with cleaning the skin. Often times these vacuums are marketed as skin health devices, with claims of cleaning out pores and washing contaminants away from the skin. However, these vacuums are not as well suited towards simple cleaning, often proving to be overly bulky and complicated. There exists a need for a specially designed beauty vacuum which is portable, accessible, and simple to use and which is attainable and affordable in comparison to similar daily use items, i.e. electric toothbrush, electric shavers, electric trimmers, etc.

It is therefore an object of the present invention to provide a compact vacuum designed for use on and around the face, neck, and other areas. The present invention is designed for basic grooming purposes and as such can be used to vacuum up hairs, superficial debris and even makeup. This will allow for debris removal without the use of fingers or other items such as q-tips, cotton pads, etc., which themselves can leave behind unwanted debris.

DETAILED DESCRIPTION OF THE INVENTION

All illustrations of the drawings are for the purpose of describing selected versions of the present invention and are not intended to limit the scope of the present invention.

Figure 1:
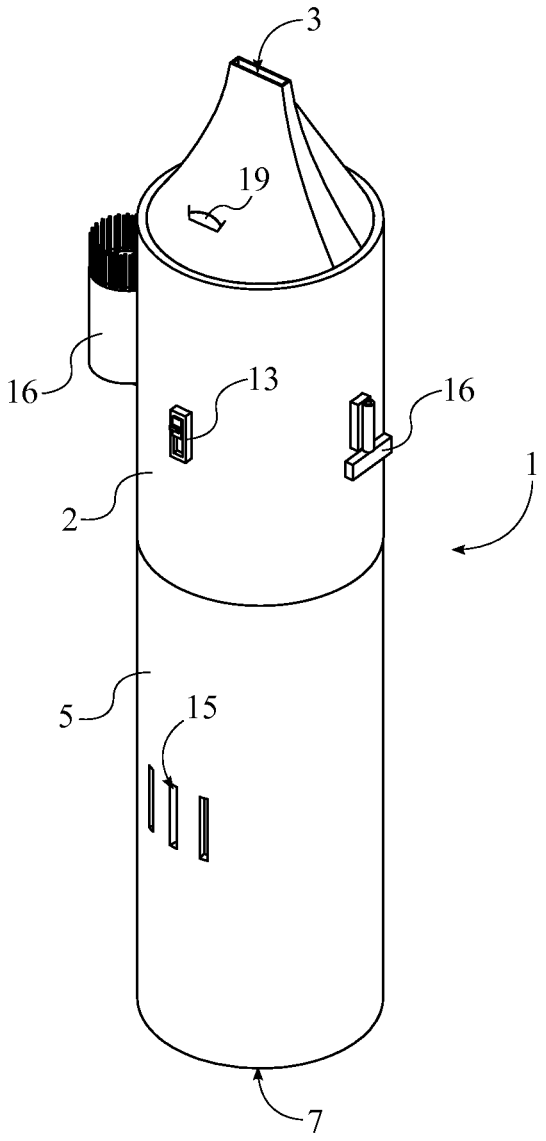
FIG. 1 is a perspective view of the present invention.
Figure 4:
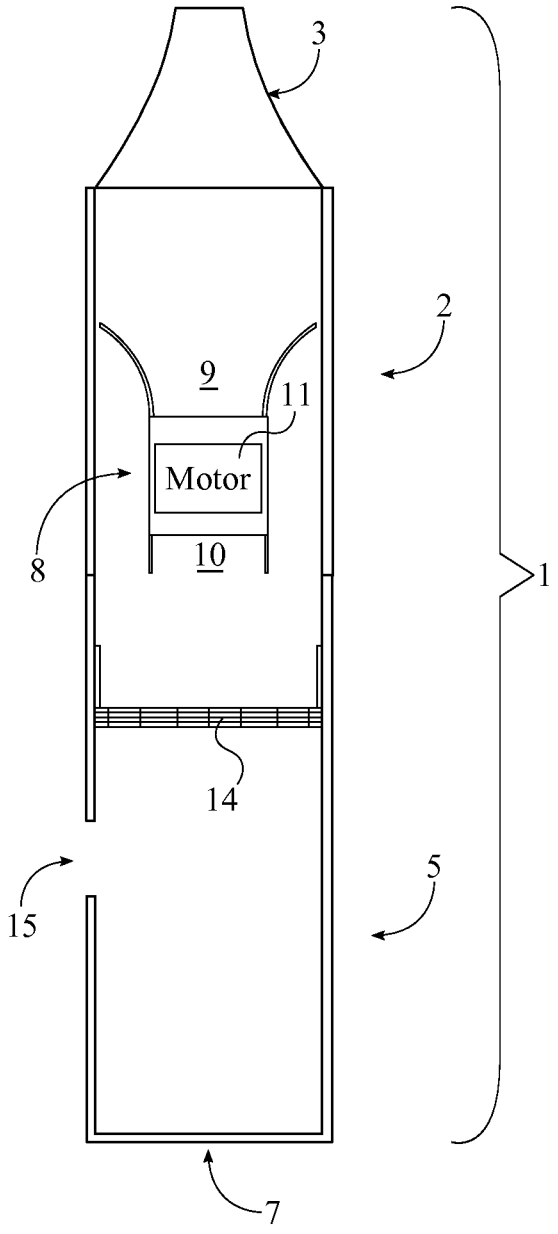
FIG. 4 is a schematic diagram of the internal components of the present invention.

As can be seen in FIGS. 1 and 4, the present invention is a cosmetic and grooming vacuum that is used to clean particulate off of a user's face such as debris, hair, or makeup. The present invention mainly comprises a casing 1, a vacuuming mechanism 8, a filtering container 14, an exhaust port 15, and a plurality of accessory nozzles 16. The casing 1 is used to house the other components of the present invention and provides a base for the other components to be connected together. The vacuuming mechanism 8 is used to lift and remove any unwanted particulate off of the user's skin. The filtering container 14 is used to collect the unwanted particulate from the exhaust of the vacuuming mechanism 8. The exhaust port 15 allows the exhaust from the vacuuming mechanism 8 to exit the casing 1. Each of the plurality of accessory nozzles 16 is used to modify the manner in which the vacuuming mechanism 8 lifts and removes the unwanted particulate.

Figure 3:
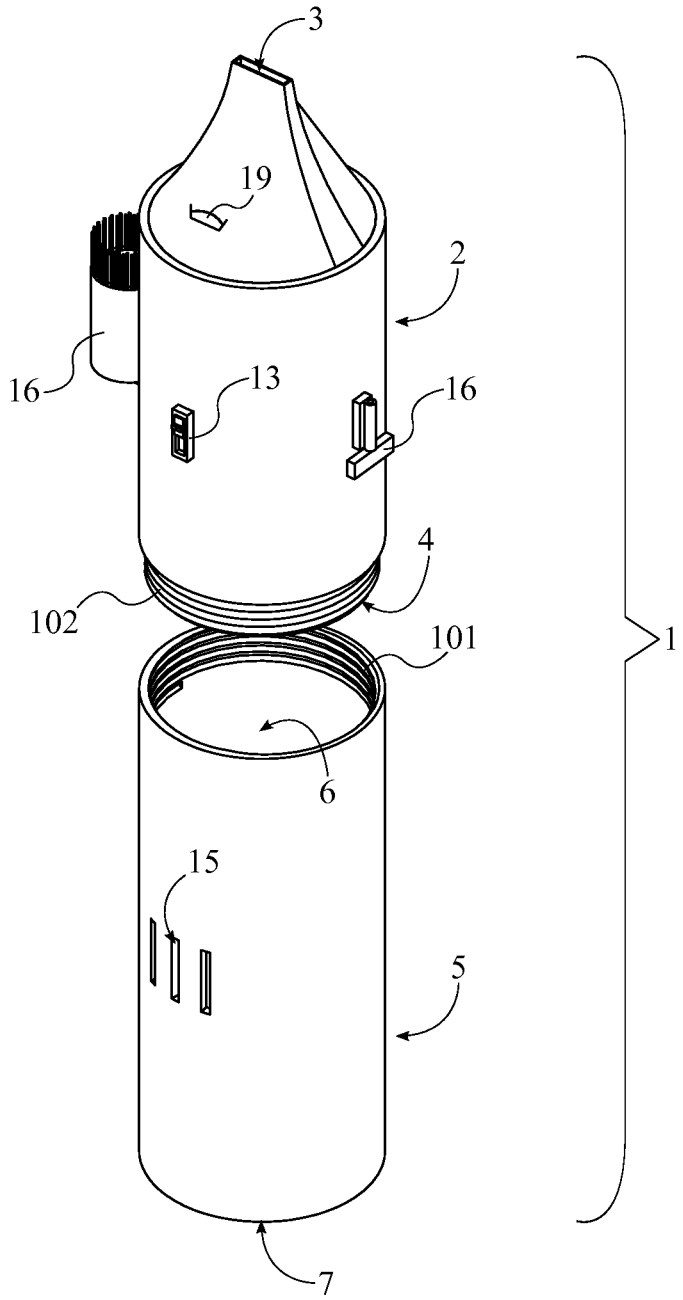
FIG. 3 is an exploded perspective view of the present invention.

The casing 1 is used to arrange and mount the other components of the present invention, which is shown in FIGS. 3 and 4. The casing 1 comprises a first section 2 and a second section 5 that have a tubular shape, which allows the other components to be housed within the casing 1. The first section 2 and the second section 5 are concentrically positioned with each other and are attached adjacent to each other. More specifically, the first section 2 comprises a suction end 3 and a first open end 4. The suction end 3 allows the vacuuming mechanism 8 to suction the unwanted particulate into the casing 1. The first open end 4 allows the vacuuming mechanism 8 to drive the unwanted particulate out of the first section 2 and into the second section 5. In addition, the second section 5 comprises a second open end 6 and a closed end 7. The second open end 6 allows the second section 5 to receive the unwanted particulate from the first section 2. The closed end 7 prevents any of the unwanted particulate from escaping the second section 5. In the preferred embodiment of the present invention, the casing 1 further comprises a female threading 101 and a male threading 102. The female threading 101 is internally integrated around the first section 2, adjacent to the second open end 6, and the male threading 102 is externally integrated around the first section 2, adjacent to the first open end 4. Consequently, the female threading 101 is able to engage the male threading 102, which allows the first section 2 and the second section 5 to form the continuous tubular shape of the casing 1. The female threading 101 and the male threading 102 also allow the first section 2 and the second section 5 to disengage from each other so that the filtering container 14 can be emptied of the unwanted particulate.

The general configuration of the components allows the unwanted particulate to travel a path through the present invention, which allows the unwanted particulate to be removed from the user's skin, collected, and disposed of by the present invention. The vacuuming mechanism 8 is positioned within the first section 2, and the filtering container 14 is positioned within the second section 5, which allows the suction end 3 to be in fluid communication with the exhaust port 15 through both the vacuuming mechanism 8 and the filtering container 14. More specifically, the vacuuming mechanism 8 comprises an intake port 9, an output port 10, and a motor 11. Fluid, such as air, surrounding the present invention is drawn into the vacuuming mechanism 8 through the intake port 9 and is expelled from the vacuuming mechanism 8 through output port 10. Thus, the intake port 9 is in fluid communication with the output port 10 through the motor 11, which is used to create a pressure differential between the intake port 9 and the output port 10. In order to properly guide the unwanted particulate through present invention, the motor 11 is used to generate a lower pressure at the intake port 9 and a higher pressure at the output port 10. The filtering container 14 is used to store the unwanted particulate in the second section 5 while still allowing air to exit through the second section 5. In addition, the suction end 3 needs to be in fluid communication with the intake port 9, and the filtering container 14 needs to be in fluid communication with the output port 10 through both the first open end 4 and the second open end 6. This configuration for the vacuuming mechanism 8 allows the unwanted particulate to be suctioned into the present invention through the suction end 3, to be guided through the casing 1, and to be collected within the filtering container 14. Moreover, the regular-pressured air outside the present invention flows in through the suction end 3 in order to bring the low pressure area to equilibrium. The air, along with the unwanted particulate, is then passed through vacuuming mechanism 8 into the filtering container 14 and out of the exhaust port 15.

Figure 5:
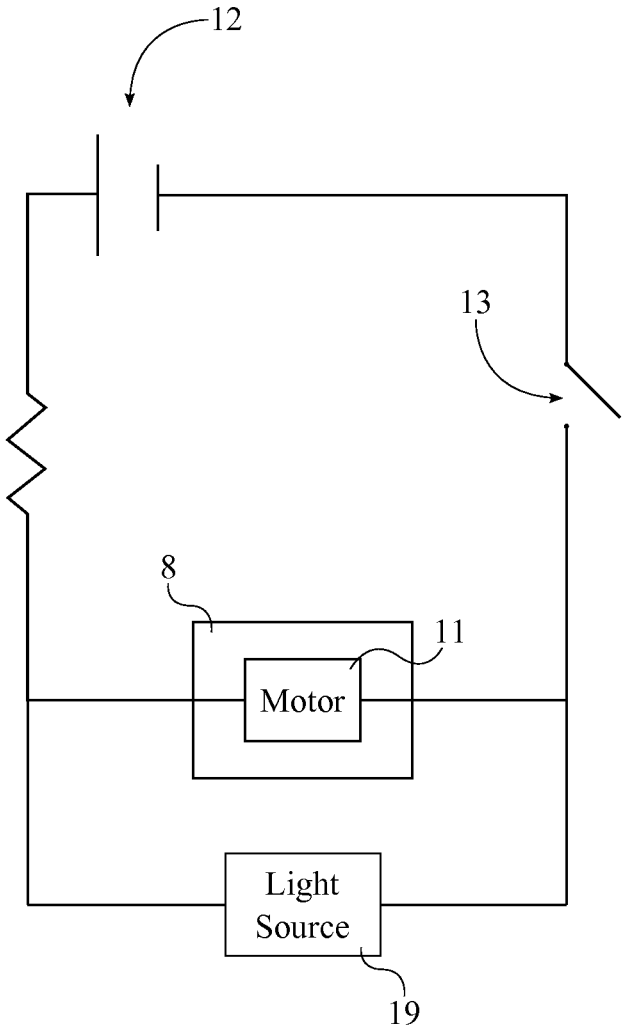
FIG. 5 is a generalized circuit diagram for the electrical components of the present invention.

As can be seen in FIG. 5, the vacuuming mechanism 8 is electrically powered and, thus, further comprises a power source 12 and a power switch 13. The power source 12 is electrically connected to the motor 11 through the power switch 13. In one embodiment of the present invention, the power source 12 is a power outlet cord that can be plugged into any standard electrical outlet. In this embodiment, the power outlet cord would be externally tether from the casing 1. In another embodiment of the present invention, the power source 12 is an internal battery, which would allow the user to better handle the present invention while moving the present invention about their body. The internal battery is mounted within the first section 2. The present invention can be designed to permanently mount the internal battery within the first section 2 if the internal battery can be recharged. In this case, the present invention would provide an adapter cord to recharge the internal battery. The present invention can also be designed to detachably mount the internal battery within the casing 1 if the internal battery is a disposable battery (i.e. alkaline batteries) so that the internal battery can be replaced. In addition, the power switch 13 is used to turn the motor 11 on and off in order to activate or deactivate the vacuuming mechanism 8. Thus, the power switch 13 is externally mounted onto the casing 1 so that the user can easily access the power switch 13.

The plurality of accessory nozzles 16 caters the suction force of the present invention to collect a specific kind of unwanted particulate from the user's skin. Thus, each of the plurality of accessory nozzles 16 is uniquely configured to serve one particular function. For example, the plurality of accessory nozzles 16 could include a brush nozzle and a pinpoint nozzle. The brush nozzle would be especially useful for removing makeup, hairs, or debris because the combined brushing and vacuuming action could be more effective at removing debris than using one of the two methods. The pinpoint tip nozzle would be designed for more precise uses of the present invention, in which the regular-sized suction end 3 is too large or unwieldy. In some instances, the user may want to vacuum up a lone hair or an errant spot of makeup without disturbing the rest of their face; the precision of the pinpoint tip nozzle would be ideally suited for such tasks. Using the pinpoint tip nozzle, the present invention would be capable of addressing mistakes in an application of makeup.

Figure 2:
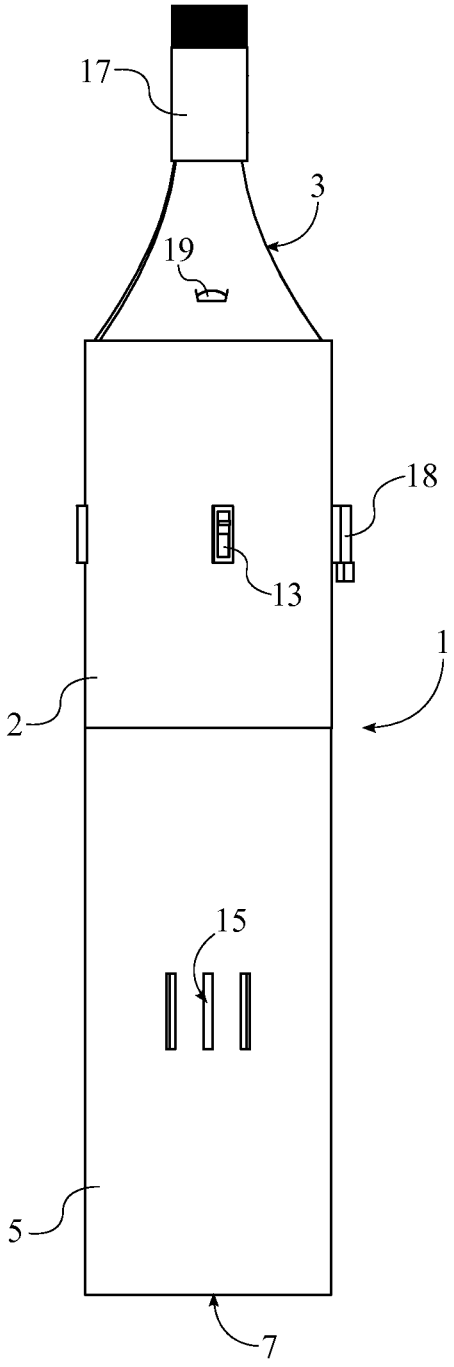
FIG. 2 is a side view of the present invention, wherein the selected nozzle is mounted onto the suction end.

In the preferred embodiment of the present invention, the positioning of each accessory nozzle 16 depends upon the user's selection. Thus, the plurality of accessory nozzles 16 will include a selected nozzle 17 and an at least one unselected nozzle 18, which are shown in FIG. 2. The selected nozzle 17 is externally attached onto the suction end 3 so that the selected nozzle 17 can modify the fluid flow into the suction end 3. The unselected nozzle 18 is laterally and detachably mounted onto the casing 1 so that the user can easily exchange one accessory nozzle for another accessory nozzle. The means of detachably mounting the unselected nozzle 18 to the casing 1 includes, but is not limited to, magnets, hook-and-loop fasteners, snap fasteners, and clip-on mechanisms. In an alternate embodiment of the present invention, each of the accessory nozzles 16 would be permanently connected to the first section 2 about a pivot point, which allows one of the accessory nozzles 16 to be rotated down when not in use and rotated up when in use.

As can be seen in FIG. 1 through 3, a light source 19 can be used to illuminate the areas on the user's skin that the user wants to clean or groom. The light source 19 can be, but is not limited, to a light emitting diode (LED). The light source 19 is externally mounted on the casing 1 and is oriented towards the suction end 3 so that the light source 19 can be easily directed by the user. In addition, the light source 19 is electrically connected to a power source 12 through a power switch 13. The power source and the power switch for the light source 19 can be the same or different from the power source 12 and the power switch 13 for the vacuum mechanism. If the power source and the power switch are the same between the light source 19 and the vacuuming mechanism 8, then the light source 19 would automatically turn on when the vacuuming mechanism 8 is on, which is convenient for the user. If the power source and the power switch are different between the light source 19 and the vacuuming mechanism 8, then the user could individually turn the light source 19 and the vacuuming mechanism 8 on or off, which allows the user to have separate control for these features.

The present invention can be provided in different sizes for men and women. Regardless of variations in size for gender, the present invention is ideally sized to be handheld. More specifically, the casing 1 should be able to be placed in a person's palm and gripped with their fingers, without the need for a handle. While variations in size of the present invention are possible, the end result should not impede the compact nature, usability, and portability of the present invention. In addition to the above, improvements may be made to the visual aesthetics of the present invention; the present invention may be sold in different colors, with various decals printed on the casing 1, with crystal accessories embedding into the casing 1, or a combination of the above. These are just a few examples of visual modifications that can be made to the present invention. These and other modifications or additions can me employed without changing the functionality of the present invention.

Although the invention has been explained in relation to its preferred embodiment, it is to be understood that many other possible modifications and variations can be made without departing from the spirit and scope of the invention as hereinafter claimed.

What is claimed is:

1. A cosmetic and grooming vacuum comprises:

a casing;

a vacuuming mechanism;

a filtering container;

an exhaust port;

a plurality of accessory nozzles, wherein each of the plurality of accessory nozzles is connected to the casing about a pivot point configured to allow one of the plurality of accessory nozzles to be rotated down when not in use and rotated up when in use;

said casing comprises a first section and a second section;

said first section comprises a suction end and a first open end;

said second section comprises a second open end and a closed end;

said first section and said second section being attached adjacent to each other;

said vacuuming mechanism being positioned within said first section;

said filtering container being positioned within said second section;

said exhaust port being integrated into said second section; and said suction end being in fluid communication with said exhaust port through said vacuuming mechanism and said filtering container.

2. The cosmetic and grooming vacuum as claimed in claim 1 comprises:

said vacuuming mechanism comprises an intake port, an output port, and a motor;

said intake port being in fluid communication with said output port through said motor;

said suction end being in fluid communication with said intake port; and said filtering container being in fluid communication with said output port through both said first open end said second open end.

3. The cosmetic and grooming vacuum as claimed in claim 1 comprises:

said vacuuming mechanism comprises a motor, a power source, and a power switch;

said power source being electrically connected to said motor through the power switch; and said power switch being bistably mounted onto said first section.

4. The cosmetic and grooming vacuum as claimed in claim 3 comprises:

said power source being a power outlet cord; and said power outlet cord being externally tethered from the casing.

5. The cosmetic and grooming vacuum as claimed in claim 3 comprises:

said power source being an internal battery; and said internal battery being mounted within said first section.

6. The cosmetic and grooming vacuum as claimed in claim 1 comprises:

said casing further comprises a female threading and a male threading;

said female threading being internally integrated around said second section, adjacent to said second open end;

said male threading being externally integrated around said first section, adjacent to said first open end; and said female threading being selectively engaged to said male threading.

7. The cosmetic and grooming vacuum as claimed in claim 1 comprises:

said plurality of accessory nozzles comprises a selected nozzle and an at least one unselected nozzle;

said selected nozzle being externally attached onto said suction end; and said unselected nozzle being laterally and detachably mounted onto said casing.

8. The cosmetic and grooming vacuum as claimed in claim 7 comprises:

one of said plurality of accessory nozzles being a brush nozzle; and another of said plurality of accessory nozzles being a pinpoint tip nozzle.

9. The cosmetic and grooming vacuum as claimed in claim 1 comprises:

a light source;

said light source being oriented towards said suction end;

said light source being externally mounted onto said casing;

said light source being electrically connected a power source; and a power switch being electrically connected between said light source and said power source.

10. A cosmetic and grooming vacuum comprises:

a casing;

a vacuuming mechanism;

a filtering container;

an exhaust port;

a plurality of accessory nozzles, wherein each of the plurality of accessory nozzles is connected to the casing about a pivot point configured to allow one of the plurality of accessory nozzles to be rotated down when not in use and rotated up when in use;

said casing comprises a first section, a second section, a female threading and a male threading;

said vacuuming mechanism comprises an intake port, an output port, and a motor;

said first section comprises a suction end and a first open end;

said second section comprises a second open end and a closed end;

said first section and said second section being attached adjacent to each other;

said vacuuming mechanism being positioned within said first section;

said filtering container being positioned within said second section;

said exhaust port being integrated into said second section;

said suction end being in fluid communication with said exhaust port through said vacuuming mechanism and said filtering container;

said intake port being in fluid communication with said output port through said motor;

said suction end being in fluid communication with said intake port;

said filtering container being in fluid communication with said output port through both said first open end said second open end;

said female threading being internally integrated around said second section, adjacent to said second open end;

said male threading being externally integrated around said first section, adjacent to said first open end; and said female threading being selectively engaged to said male threading.

11. The cosmetic and grooming vacuum as claimed in claim 10 comprises:

said vacuuming mechanism comprises a motor, a power source, and a power switch;

said power source being electrically connected to said motor through the power switch; and said power switch being bistably mounted onto said first section.

12. The cosmetic and grooming vacuum as claimed in claim 11 comprises:

said power source being a power outlet cord; and said power outlet cord being externally tethered from the casing.

13. The cosmetic and grooming vacuum as claimed in claim 11 comprises:

said power source being an internal battery; and said internal battery being mounted within said first section.

14. The cosmetic and grooming vacuum as claimed in claim 10 comprises:

a light source;

said light source being oriented towards said suction end;

said light source being externally mounted onto said casing;

said light source being electrically connected a power source; and a power switch being electrically connected between said light source and said power source.

15. A cosmetic and grooming vacuum comprises:

a casing;

a vacuuming mechanism;

a filtering container;

an exhaust port;

a plurality of accessory nozzles, wherein each of the plurality of accessory nozzles is connected to the casing about a pivot point configured to allow one of the plurality of accessory nozzles to be rotated down when not in use and rotated up when in use;

a light source;

said casing comprises a first section, a second section, a female threading and a male threading;

said vacuuming mechanism comprises an intake port, an output port, and a motor;

said first section comprises a suction end and a first open end;

said second section comprises a second open end and a closed end;

said first section and said second section being attached adjacent to each other;

said vacuuming mechanism being positioned within said first section;

said filtering container being positioned within said second section;

said exhaust port being integrated into said second section;

said suction end being in fluid communication with said exhaust port through said vacuuming mechanism and said filtering container;

said intake port being in fluid communication with said output port through said motor;

said suction end being in fluid communication with said intake port;

said filtering container being in fluid communication with said output port through both said first open end said second open end;

said female threading being internally integrated around said second section, adjacent to said second open end;

said male threading being externally integrated around said first section, adjacent to said first open end;

said female threading being selectively engaged to said male threading;

said light source being oriented towards said suction end;

said light source being externally mounted onto said casing;

said light source being electrically connected a power source; and a power switch being electrically connected between said light source and said power source.

16. The cosmetic and grooming vacuum as claimed in claim 15 comprises:

said vacuuming mechanism comprises a motor, a power source, and a power switch;

said power source being electrically connected to said motor through the power switch; and said power switch being bistably mounted onto said first section.

17. The cosmetic and grooming vacuum as claimed in claim 16 comprises:

said power source being a power outlet cord; and said power outlet cord being externally tethered from the casing.

18. The cosmetic and grooming vacuum as claimed in claim 16 comprises:

said power source being an internal battery; and said internal battery being mounted within said first section.

* * * * *